US005575143A

United States Patent [19]

Gengler

[11] Patent Number: 5,575,143

[45] Date of Patent: Nov. 19, 1996

[54] AIR DIRECTING APPARATUS FOR USE WITH TEXTILE MACHINES AND THE LIKE

[75] Inventor: Mark S. Gengler, Shelby, N.C.

[73] Assignee: Pneumafil Corporation, Charlotte, N.C.

[21] Appl. No.: 425,183

[22] Filed: Apr. 19, 1995

[51] Int. Cl.[6] ..... D01H 5/28; D01H 13/26

[52] U.S. Cl. ..... 57/308; 57/300; 57/301; 57/304; 57/306; 57/406

[58] Field of Search ..... 57/300, 302, 301, 57/304, 306, 308, 406, 411, 415

[56] References Cited

U.S. PATENT DOCUMENTS

| | | | |
|---|---|---|---|
| 3,782,095 | 1/1974 | Bures et al. | 57/301 |
| 3,816,987 | 6/1974 | Hofsetter | 57/308 |
| 3,926,665 | 12/1975 | Harrap et al. | 57/301 |
| 4,628,677 | 12/1986 | Turner et al. | 57/301 |
| 5,157,910 | 10/1992 | Artzt et al. | 57/308 |
| 5,261,220 | 11/1993 | Stahlecker | 57/308 |
| 5,287,693 | 2/1994 | Stahlecker | 57/308 |
| 5,321,942 | 6/1994 | Hartness | 57/301 |
| 5,375,406 | 12/1994 | Gorlich et al. | 57/308 |

FOREIGN PATENT DOCUMENTS

| | | | |
|---|---|---|---|
| 2419188 | 11/1975 | Germany | 57/304 |

*Primary Examiner*—William Stryjewski
*Attorney, Agent, or Firm*—Shefte, Pinckney & Sawyer

[57] ABSTRACT

Apparatus for supplying conditioned air to spinning machines which includes a duct for transporting conditioned air to the machine, such duct having an opening through which the conditioned air exits the duct. An air diffuser is mounted on the duct adjacent the opening therein, and it includes a generally V-shaped air directing wall that has upper flanges extending outwardly therefrom, with openings in such flanges, whereby a minor portion of the conditioned air flows upwardly through the openings in the flange and is directed toward the open end spinning machine, and a major portion of the conditioned air is directed outwardly toward the sliver being fed to the machine.

6 Claims, 4 Drawing Sheets

AIR DIRECTING APPARATUS FOR USE WITH TEXTILE MACHINES AND THE LIKE

BACKGROUND OF THE INVENTION

The present invention relates generally to apparatus for directing conditioned air in a desired direction and, more particularly, to an apparatus for directing air along a predetermined path toward equipment, such as textile spinning machines.

As set forth in greater detail in Hartness U.S. Pat. No. 5,321,942, which is incorporated herein by reference, it is important in many yarn processing operations that the humidity and the temperature of the ambient air be carefully controlled to improve the quality of the yarn being processed and to reduce the tendency of the yarn to break in subsequent processing operations, such as knitting and weaving operations.

Briefly summarized, the aforesaid Hartness patent discloses an improved arrangement for distributing conditioned air to a spinning machine along a predetermined flow path that includes a duct or conduit positioned between adjacent rotating rotors of an open end spinning machine, and such duct is formed with a plurality of openings arranged to cause the conditioned air exiting from the duct to flow first in a generally horizontal direction toward the spin boxes of the open end spinning machine, and with a portion of the conditioned air being directed to flow across the yarn being processed.

While the duct arrangement disclosed in the Hartness patent offers a more desirable flow of the conditioned air as compared with other prior arrangements, particularly in terms of cooling the rotors of open end spinning machines, in some applications the energy of the conditioned air which is directed across the sliver being fed to the rotor was sufficient to cause some damage to the sliver, usually in the form of fuzzing.

The present invention provides an air conditioning apparatus which directs the conditioned air in a particular, controlled flow path which cools the spinning machines without damaging the sliver being fed to the machine.

SUMMARY OF THE INVENTION

In accordance with the present invention, an air conditioning apparatus for use with a spinning machine or the like is provided, which comprises a duct for transporting conditioned air to such machine, such duct including an opening through which said conditioned air exits the duct, and an air diffuser mounted on the duct adjacent the opening therein. The air diffuser includes an air directing wall shaped to direct the major portion of the conditioned air exiting from said duct generally outwardly from the duct and toward and between the sliver cans located in an area beneath the machine, and the wall has an upper portion that is formed with a plurality of openings therein having a predetermined area which results in a minor portion of the conditioned air being caused to flow upwardly through the openings and be directed toward: the bottom of the machine, the sliver being fed to the machine, and the rotors of the machine. This air distribution pattern results in a portion of the conditioned air being directed at the critical parts of the spinning process (e.g., the hot rotors in an open end spinning machine and the sliver being spun), and a large portion of the conditioned air forming a generous pool of conditioned air in and around the immediate area of the machine from the floor up to the sliver intake to the machine.

In the preferred embodiment of the present invention, the air directing wall is generally V-shaped, with the upper portions thereof extending outwardly in a generally horizontal direction, such upper portions having said plurality of openings formed therein. Also, the air directing wall is preferably supported at each of its ends so as to be positioned with the lowest point of the V-shaped wall located above the opening in the duct, and the duct includes air control means for regulating the size of the opening in the duct to thereby control the amount of the conditioned air passing through the opening in the duct.

DETAILED DESCRIPTION OF THE PREFERRED EMBODIMENT

Figure 1:
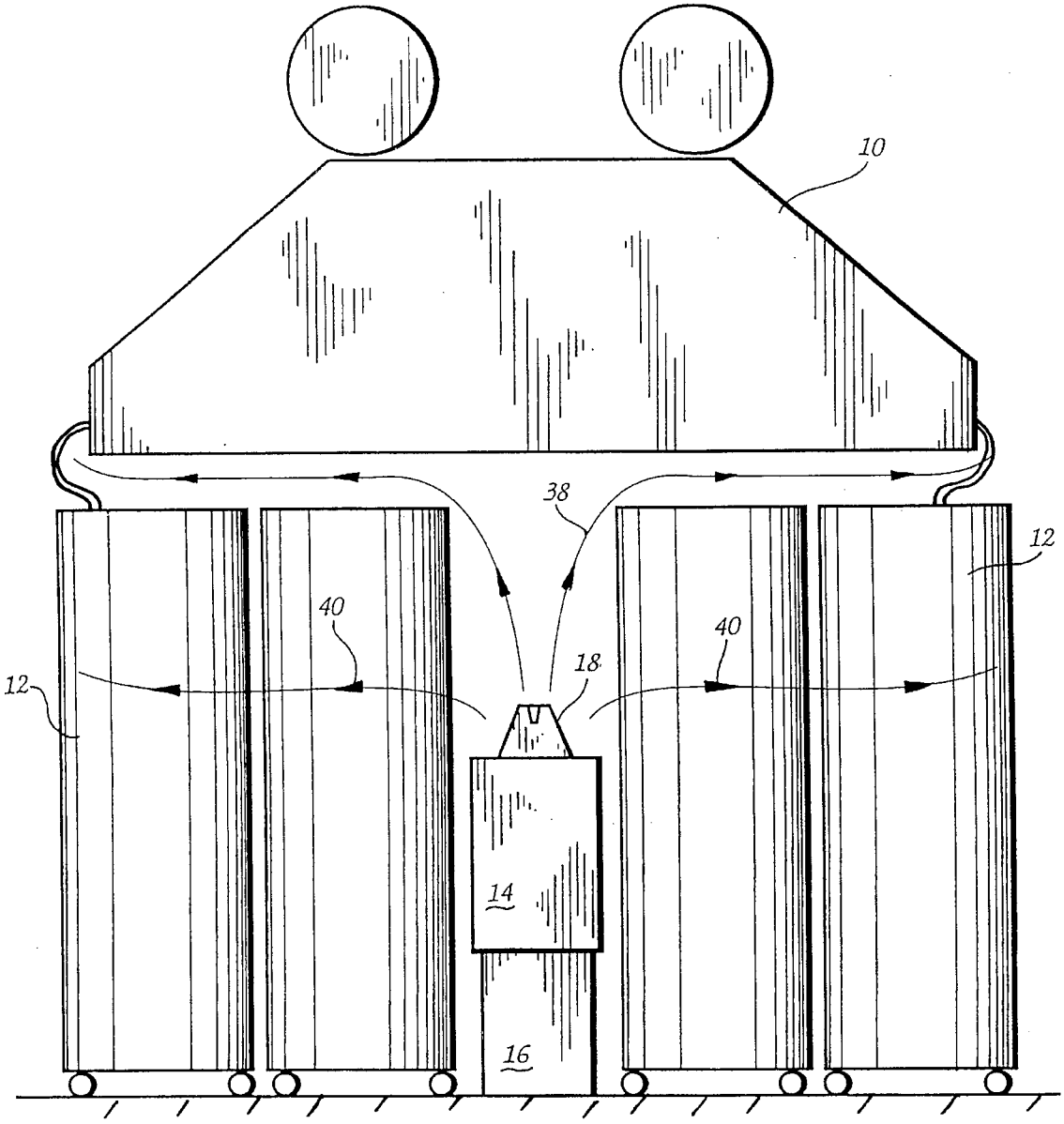
FIG. 1 is a schematic view generally illustrating the position of the air conditioning apparatus of the present invention in a typical spinning machine application.

Looking now in greater detail at the accompanying drawings, FIG. 1 is a schematic illustration of a typical application of the unique air conditioning apparatus of the present invention. More specifically, FIG. 1 illustrates the frame of an open end spinning machine 10 and a plurality of sliver cans 12 from which slivers are fed into the open end spinning machine 10 and formed into a yarn, all in a conventional manner. A duct 14 for transporting conditioned air to the open end spinning machine 10 is supported on a support leg 16 at a position intermediate the sliver cans 12 and beneath the frame of the open end spinning machine 10. An air diffuser 18, which will be described in greater detail presently, is mounted at the top surface of the duct 14.

Figure 2:
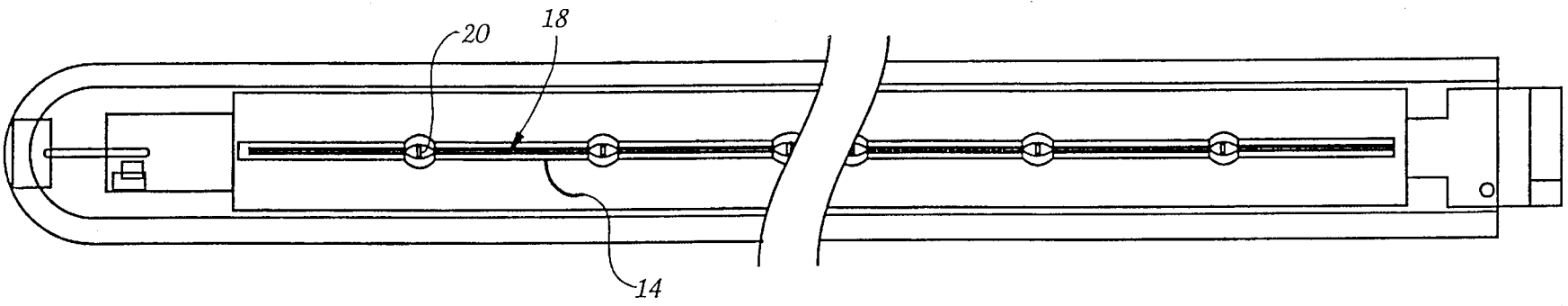
FIG. 2 is a top plan view of an air conditioning apparatus according to the present invention.
Figure 3:
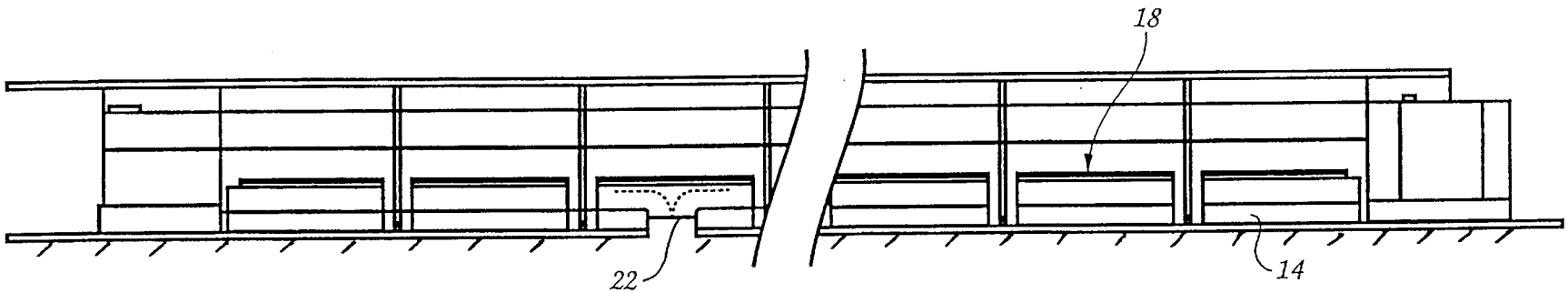
FIG. 3 is a side elevational view of the air conditioning apparatus illustrated in FIG. 2.
Figure 4:
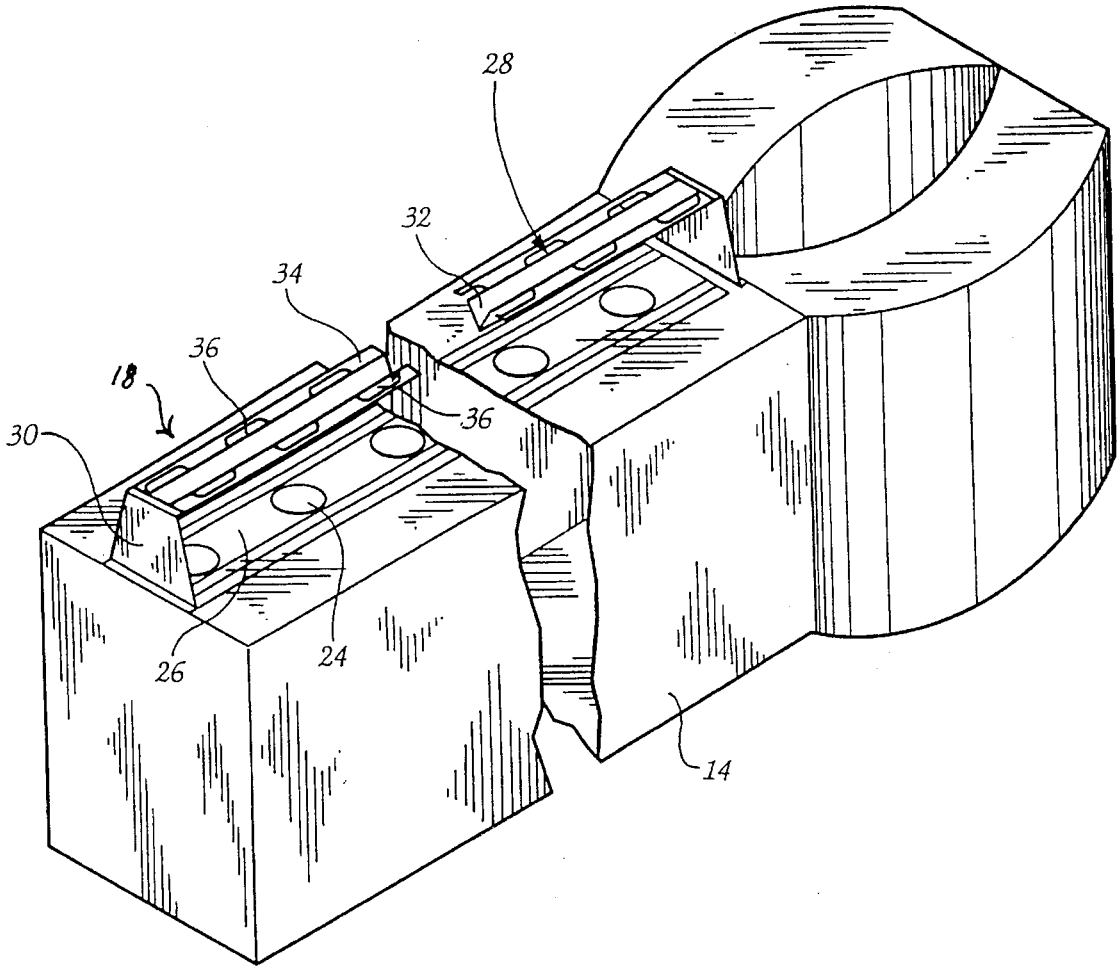
FIG. 4 is a detailed perspective view, partially in section, of the air conditioning apparatus illustrated in FIGS. 2 and 3.

As best seen in FIG. 2, which is a plan view of the duct 14 and air diffuser 18, and FIG. 3, which is a side elevational view of these components, a single duct 14 is used to supply conditioned air to a plurality of adjacent open end spinning machine sections, the legs 20 of which pass downwardly through the duct 14, and each segment of the duct 14 supplies conditioned air to a different open end spinning machine section 10. The conditioned air flows into the duct 14 from any convenient source (not shown) through an inlet opening 22 and it is distributed in both directions along the length of the duct 14 and, in a typical application, the pressure within the duct 14 is maintained at a constant pressure of one-half inch of water so that there is a uniform flow of the conditioned air from the duct 14. As best seen in FIG. 4, the top surface of the duct 14 is provided with either a slot or circular openings 24 over which a cover plate 26 is mounted in sliding relation along the upper surface of the duct 14, the sliding plate 26 being formed with openings corresponding to the openings 24 in the duct 14 so that the sliding plate 26 can be moved to any desired position to regulate the size of the openings 24 and thereby control the quantity of air flowing upwardly through the openings 24. The air diffuser 18 is mounted on each segment of the duct 14 by vertically extending mounting plates 30 located at each end of each air diffuser 18. The air diffuser 18 has a generally V-shaped configuration with the point or lower end of the "V" being positioned just above the openings 24 and extending along the length of the segment of the duct 14 along a line through the center of the slotted or circular openings 24. The air diffuser 18 also includes outwardly extending horizontal flanges 34 that extend outwardly from the upper ends of the V-shaped portion 32, and each of these horizontally extending flanges 34 is formed with a plurality of openings 36 therein.

The size of the openings 36 is selected so as to have a predetermined area which results in a minor portion of the conditioned air flowing upwardly from the duct 14 so as to be directed toward the open end spinning machine as indicated by the arrows 38 in FIG. 1, and with the remaining major portion of such conditioned air being directed outwardly from the air diffuser 18 in a generally horizontal direction toward and between the sliver cans 12 in an area located beneath the open end spinning machine, as indicated by the arrows 40 in FIG. 1. For example, in a typical application of the present invention, the flanges 34 have a width of approximately one inch, and each of the openings 36 is in the form of a slot having a length of two inches and a width of one-half inch, and the slots are typically spaced from one another at intervals of about two inches.

By virtue of the arrangement described above, the unique apparatus of the present invention provides an air flow pattern for the conditioned air that is particularly effective in distributing such conditioned air to the areas where it is most needed, and without any adverse effect on the sliver being fed to the open end spinning machine 10. Thus, as best seen in FIG. 1, the minor portion of the conditioned air is caused to flow directly to the open end spinning machine 10 so as to pass over the critical spinning components thereof, such as the hot rotors and cover plates (not shown), and thereby provide the necessary cooling effect required by the conditioned air, and, at the same time, a major portion of the conditioned air is directed generally outwardly so as to create and maintain a pool of conditioned air in and around the open end spinning machine 10 from the floor up to the sliver intake to the machine, and in an area generally surrounding the sliver cans 12 and the sliver being fed therefrom, whereby the conditioned air is applied to the sliver to condition the sliver in the desired manner. Moreover, the conditioned air is applied to the sliver in a gentle flow pattern that does not disrupt the sliver so that the quality of the yarn ultimately formed by the open end spinning machine 10 is improved.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for supplying conditioned air to a spinning machine, comprising:

(a) a duct for transporting conditioned air to the spinning machine, said duct including an opening through which conditioned air exits said duct; and (b) an air diffuser mounted on said duct in the path of conditioned air exiting from said duct, said air diffuser including an air directing wall shaped to direct a major portion of conditioned air exiting from said duct toward and between sliver cans in an area located beneath the spinning machine, and including a plurality of openings of a predetermined area formed in said wall so that a minor portion of conditioned air flows through said openings and is directed toward the spinning machine itself.

2. An apparatus for supplying conditioned air as defined in claim 1, wherein said duct includes an upper, generally horizontal surface, and wherein said opening in said duct is formed in said upper surface and extends generally longitudinally therealong.

3. An apparatus for supplying conditioned air as defined in claim 1, wherein said air directing wall is generally V-shaped, with the upper portions thereof extending outwardly in a generally horizontal direction, said upper portions having said plurality of openings formed therein.

4. An apparatus for supplying conditioned air as defined in claim 3, wherein said air directing wall is supported at each of its ends to be positioned with the lowest point of said V-shaped wall located above said opening in said duct.

5. An apparatus for supplying conditioned air as defined in claim 3, wherein said duct includes air control means for regulating the size of said opening in said duct to thereby control the amount of said air passing through said opening in said duct.

6. (Amended) An apparatus for supplying conditioned air for use in a spinning machine, comprising:

(a) a longitudinally extending duct for transporting conditioned air to the spinning machine, said duct including an opening therein extending along the longitudinal extend of said duct, and control means mounted on said duct for regulating the size of said opening to thereby control the amount of conditioned air passing through said opening; and (b) an air diffuser mounted directly above said opening in said duct and in the path of the conditioned air passing therethrough, said air diffuser including an air directing wall having a lower portion which is generally V-shaped and upper portions that extend generally horizontally outwardly from each of the upper ends of said V-shaped lower portion, said upper portions having openings therein which have a predetermined area that results in a minor portion of the conditioned air flowing upwardly through said openings and directly toward the spinning machine, and results in a major portion of said conditioned air being directed outwardly from said air diffuser toward an area located generally beneath the spinning machine.

* * * * *